US007806173B2

(12) United States Patent
Kaul et al.

(10) Patent No.: US 7,806,173 B2
(45) Date of Patent: Oct. 5, 2010

(54) APPARATUS AND METHODS TO DISSIPATE HEAT IN A DOWNHOLE TOOL

(75) Inventors: Anmol Kaul, Stafford, TX (US); Lennox E. Reid, Jr., Houston, TX (US); Barbara Zielinska, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 396 days.

(21) Appl. No.: 11/766,587

(22) Filed: Jun. 21, 2007

(65) Prior Publication Data

US 2008/0314638 A1 Dec. 25, 2008

(51) Int. Cl.
*E21B 36/00* (2006.01)

(52) U.S. Cl. ..... 166/57; 175/17

(58) Field of Classification Search ..... 166/302, 166/57; 175/17; 165/109.1
See application file for complete search history.

(56) References Cited

U.S. PATENT DOCUMENTS 4,786,233 A 11/1988 Shizuya et al.
5,931,000 A * 8/1999 Turner et al. ..... 62/3.2
6,412,575 B1 7/2002 Harrigan et al.
6,769,487 B2 * 8/2004 Hache ..... 166/302
2006/0144619 A1 7/2006 Storm, Jr. et al.
2006/0191682 A1 * 8/2006 Storm et al. ..... 166/250.01
2007/0114021 A1 5/2007 Brown et al.

FOREIGN PATENT DOCUMENTS

WO WO9609906 4/1996

* cited by examiner

*Primary Examiner*—Kenneth Thompson
*Assistant Examiner*—David Andrews
(74) *Attorney, Agent, or Firm*—Dave R. Hofman

(57) ABSTRACT

A downhole tool configured for conveyance within a wellbore extending into a subterranean formation, the tool comprising an electronics system and a heat-dissipating apparatus. The electronics system includes a controller, a memory, and surface communicating means, at least one of which is a heat-generating source. The heat-dissipating apparatus includes: a chassis engaging the heat-generating source and having a fluid passageway allowing fluid flow therethrough; a radiator for further heat dissipation; a pump; sensors to measure temperature of the chassis and the wellbore; and a compensator to regulate the pressure of fluid in the passageway.

11 Claims, 10 Drawing Sheets

APPARATUS AND METHODS TO DISSIPATE HEAT IN A DOWNHOLE TOOL

FIELD OF THE DISCLOSURE

The present disclosure relates generally to borehole tool systems and, more particularly, to apparatus and methods to dissipate heat in a downhole tool.

BACKGROUND

Producing reservoir wells involves drilling subsurface formations and monitoring various subsurface formation parameters. Drilling and monitoring typically involves using downhole tools having high-power electronic devices. During operation, the electronic devices generate heat that often builds up in a downhole tool. The built up heat can be detrimental to the operation of the downhole tool. A traditional technique for dissipating the heat involves using heat sinks in a downhole tool. Another traditional technique involves using evaporation-condensation cycle heat pipes that use passive flow capillary action to carry heat away from a heat source. In an evaporation-condensation cycle, a fluid in a closed loop heat pipe evaporates when it draws heat. In the gaseous state, the vapor carries the heat away using passive flow capillary action. Upon cooling, the vapor condenses into a fluid, which can again be evaporated to transfer additional heat in the gaseous state.

SUMMARY

In accordance with a disclosed example, an example tool collar includes a body having a first outer surface, a first fluid inlet, and a first fluid outlet. The example tool collar also includes a passageway formed therethrough, a second fluid inlet to engage the first fluid outlet of the body, a second fluid outlet to engage the first fluid inlet of the body, and a first inner surface having at least one protrusion extending into the passageway.

In accordance with another disclosed example, an example apparatus to dissipate heat includes a body and a first inflow passageway extending along a portion of the body. The first inflow passageway carries a first fluid portion toward a first heat-generating member. The first inflow passageway includes a passageway surface and at least one protrusion extending from the passageway surface into the first inflow passageway. The example apparatus also includes an outflow passageway coupled to the first inflow passageway to carry the first fluid portion away from the heat-generating member.

In accordance with yet another disclosed example, an example method to dissipate heat involves moving fluid through a passageway and transferring heat from a heat-generating member to the fluid. The example method also involves mixing the fluid in the passageway using at least one protrusion formed in the passageway and dissipating the heat from the fluid.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
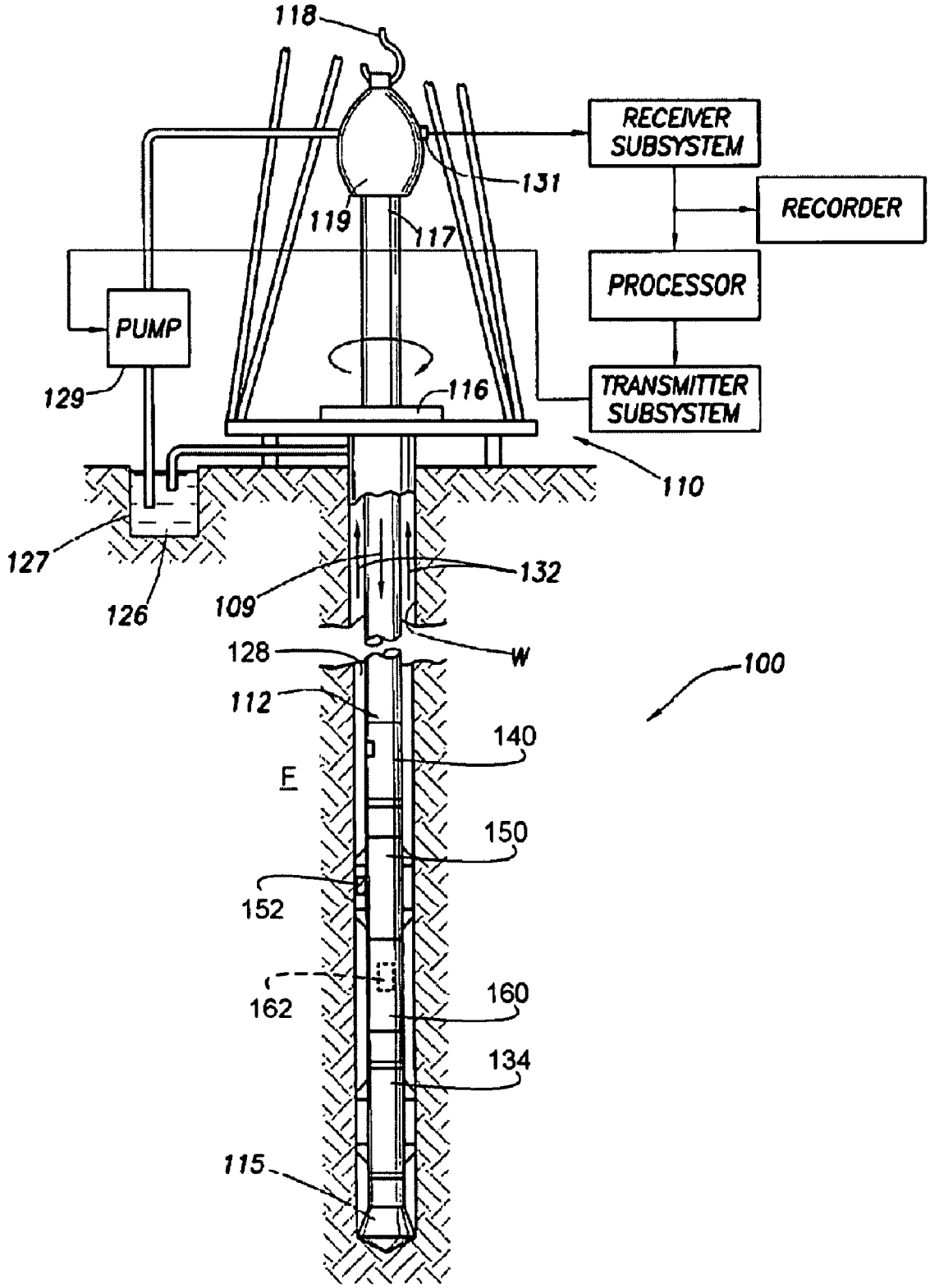
FIG. 1 illustrates a drilling rig and drill string that may be configured to use the example apparatus and methods described herein.

FIG. 1 illustrates an example drilling rig 110 and a drill string 112 in which the example apparatus and methods described herein can be used to dissipate heat from a heat-generating component. In the illustrated example, a land-based platform and derrick assembly 110 are positioned over a wellbore W penetrating a subsurface formation F. In the illustrated example, the wellbore W is formed by rotary drilling in a manner that is well known. However, those of ordinary skill in the art given the benefit of this disclosure will appreciate that the present invention also finds application in directional drilling applications as well as rotary drilling, and the example apparatus and methods described herein are not limited to land-based rigs.

The drill string 112 is suspended within the wellbore W and includes a drill bit 115 at its lower end. The drill string 112 is rotated by a rotary table 116, which engages kelly 117 at an upper end of the drill string 112. The drill string 112 is suspended from a hook 118, attached to a traveling block (not shown) through the kelly 117 and a rotary swivel 119, which permits rotation of the drill string 112 relative to the hook 118.

A drilling fluid or mud 126 is stored in a pit 127 formed at the well site. A pump 129 is provided to deliver the drilling fluid 126 to the interior of the drill string 112 via a port (not shown) in the swivel 119, inducing the drilling fluid 126 to flow downwardly through the drill string 112 in a direction generally indicated by arrow 109. The drilling fluid 126 exits the drill string 112 via ports (not shown) in a drill bit 115, and then the drilling fluid 126 circulates upwardly through an annulus 128 between the outside of the drill string 112 and the wall of the wellbore W in a direction generally indicated by arrows 132. In this manner, the drilling fluid 126 lubricates the drill bit 115 and carries formation cuttings up to the surface as it is returned to the pit 127 for recirculation.

The drill string 112 further includes a bottom hole assembly 100 near the drill bit 115 (e.g., within several drill collar lengths from the drill bit 115). The bottom hole assembly 100 includes drill collars described below to measure, process, and store information, as well as a surface/local communications subassembly 140.

In the illustrated example, the drill string 112 is further equipped with a stabilizer collar 134. Stabilizing collars are used to address the tendency of the drill string to "wobble" and become decentralized as it rotates within the wellbore W, resulting in deviations in the direction of the wellbore W from the intended path (e.g., a straight vertical line). Such deviations can cause excessive lateral forces on sections (e.g., collars) of the drill string 112 as well as the drill bit 115, producing accelerated wear. This action can be overcome by providing one or more stabilizer collars to centralize the drill bit 115 and, to some extent, the drill string 112, within the wellbore W. Examples of centralizing tools that are known in the art include pipe protectors and other tools, in addition to stabilizers. The example apparatus and methods described herein can be advantageously used to dissipate heat generated by components, devices, or members that generate heat such as, for example, electrical systems.

In the illustrated example, the bottom hole assembly 100 is provided with a probe tool 150 having an extendable probe 152 to draw formation fluid from the formation F into a flow line of the probe tool 150. A pump (not shown) is provided in, for example, another tool collar 160 to draw the formation fluid via the probe tool 150. In the illustrated example, to power the pump, the tool collar 160 is provided with an electrical current-generating alternator (e.g., an electricity generator) and associated electrical components 162. The alternator 162 is electrically coupled to the pump, and a turbine (not shown) powered by the flow of the drilling fluid 126 is provided in the tool collar 160 to actuate the alternator 162. Over time, as the alternator 162 generates electrical current, the alternator and its associated components 162 generate heat. The example apparatus and methods described herein can be advantageously used to dissipate the heat generated by the alternator and/or its associated components 162 during operation. In addition, the example apparatus and methods described herein may be used to dissipate heat directly from electrical components or other heat-generating sources or from heat sinks coupled to the electrical components or heat generating sources.

The example apparatus and methods described herein are not restricted to drilling operations. The example apparatus and methods described herein can also be advantageously used during, for example, well testing or servicing. Further, the example methods and apparatus can be implemented in connection with testing conducted in wells penetrating subterranean formations and in connection with applications associated with formation evaluation tools conveyed downhole by any known means.

Figure 2:
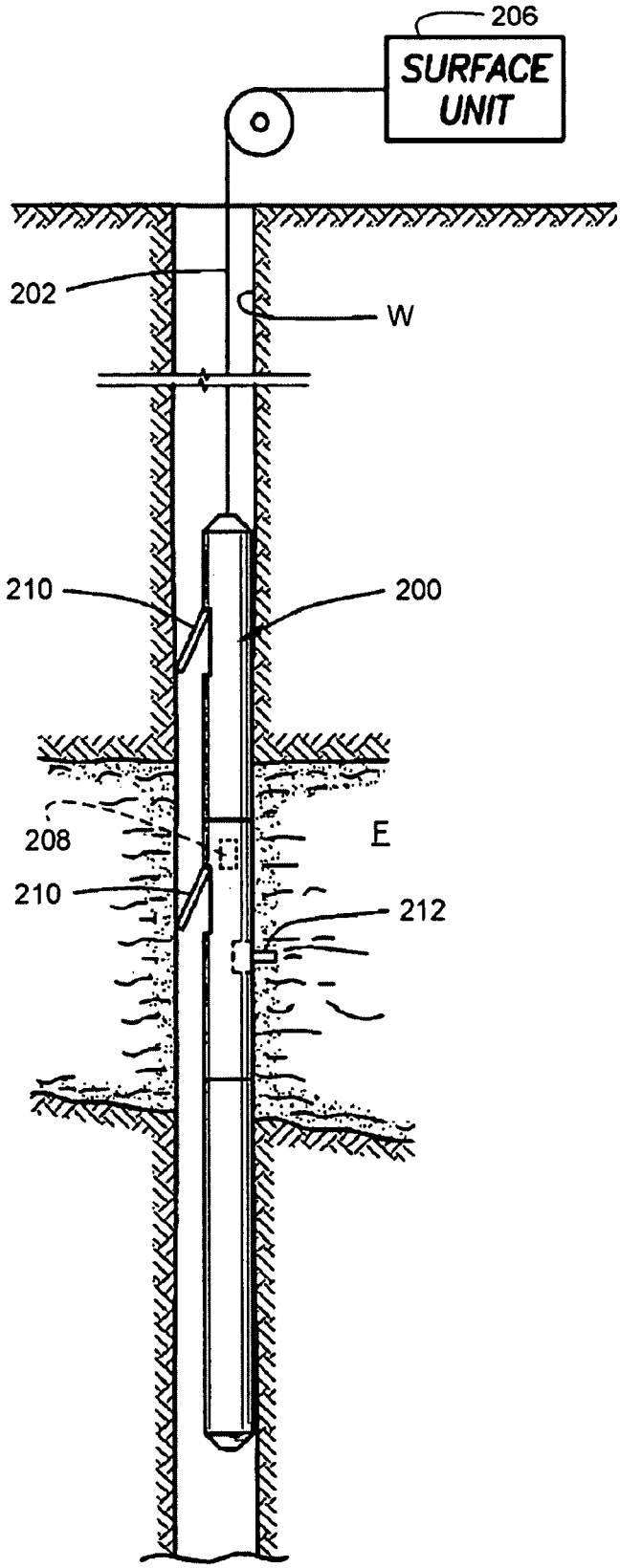
FIG. 2 illustrates a cross-section of a wellbore with a wireline tool suspended in the wellbore that may be configured to use the example apparatus and methods described herein.

FIG. 2 illustrates an example wireline tool 200 suspended by a wireline 202 in a wellbore W of a formation F. The wireline 202 may be implemented using a multiconductor cable 202 coupled to an electrical system 206, which may include a receiver subsystem, a processor, a recorder, and a transmitter subsystem. The wireline tool 200 includes an elongated body having a plurality of collars. In the illustrated example, the wireline tool 200 also includes a downhole electrical control system 208 in one of the collars to control operations of the wireline tool 200 and to deliver electrical power to different electrical subsystems of the wireline tool 200. The wireline 202 may be used to deliver electrical power from the electrical system 206 to the downhole electrical control system 208 and other electrical portions of the wireline tool 200. In addition, the wireline 202 may be used to communicate information between the systems 206 and 208. The example apparatus and methods described herein can be used to dissipate heat generated by the downhole electrical control system 208 during operation.

In the illustrated example, the wireline tool 200 is a sidewall coring tool, which may be implemented in accordance with U.S. Pat. No. 6,412,575, which is assigned to the assignee of the present invention. In the illustrated example, the wireline tool 200 is provided with one or more support arms 210 to brace against the wellbore W, and the wireline tool 200 is configured to extract samples from the formation F using a coring bit 212 that extends from the wireline tool 200 into the formation F. The samples can then be tested and analyzed by the wireline tool 200 or can be stored in the wireline tool 200 and taken to the surface for testing and analysis.

To turn the coring bit 212, the wireline tool 200 is provided with a motor (not shown), and to extend the support arms 210, the wireline tool 200 is provided with actuators (not shown). The motor and the actuators may be powered and/or controlled by the downhole electrical control system 208. Over time, the downhole electrical control system 208 generates heat while powering and/or controlling the motor and the actuators. The example apparatus and methods described herein can be advantageously used to dissipate the heat generated by the downhole electrical control system 208.

Although the example wireline tool 200 is shown as a sidewall coring tool, the example apparatus and methods described herein can be implemented in connection with any other type of downhole tool.

Figure 3:
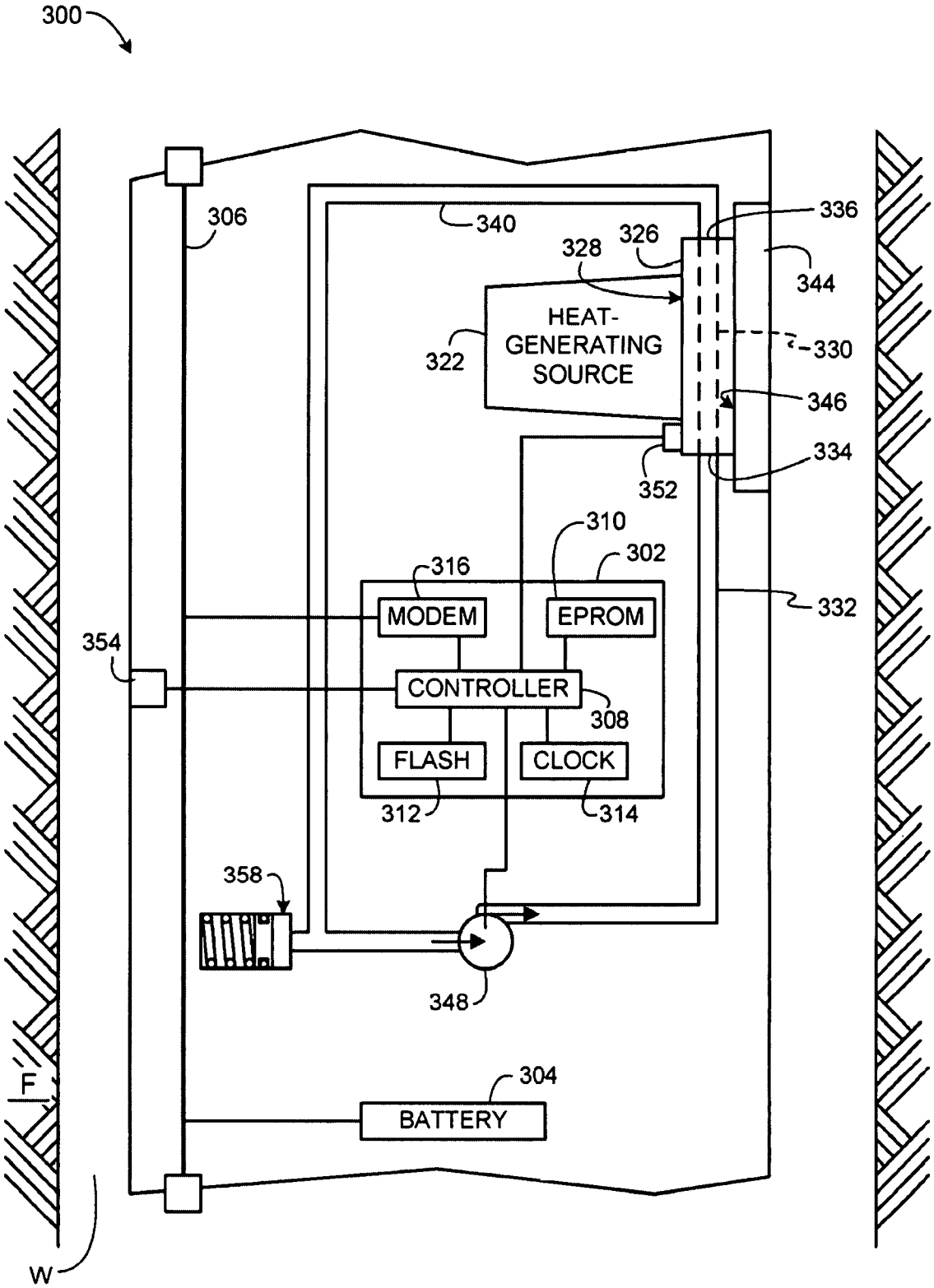
FIG. 3 depicts a block diagram of an example apparatus that may be implemented in the drill string of FIG. 1 and/or the wireline tool of FIG. 2 to dissipate heat from heat-generating components.

FIG. 3 depicts a block diagram of an example apparatus 300 that may be implemented in the drill string 112 of FIG. 1 and/or the wireline tool 200 of FIG. 2 to dissipate heat from heat-generating components using flow-induced convective heat transfer. In the illustrated example of FIG. 3, lines shown connecting blocks represent fluid or electrical connections that may comprise one or more flow lines (e.g., hydraulic fluid flow lines or formation fluid flow lines) or one or more wires or conductive paths respectively.

The example apparatus 300 is provided with an electronics system 302 and a battery 304 to power the electronics system 302. In the illustrated example, the electronics system 302 is configured to control operations of the example apparatus 300 to dissipate heat from heat-generating components. Additionally, the electronics system 302 may also be configured to control other operations of the drill string 112 and/or the wireline tool 200 including, for example, formation fluid sample extraction operations, test and analysis operations, data communication operations, etc. For example, the electronics system 302 may be used to implement the components used to control the alternator 162 of FIG. 1 and/or may be used to implement the downhole electrical control system 208 of FIG. 2. In the illustrated example, the battery 304 is connected to a tool bus 306 configured to transmit electrical power and communication signals.

The electronics system 302 is provided with a controller 308 (e.g., a CPU and Random Access Memory) to implement control routines such as, for example, routines that control heat dissipation operations of the example apparatus 300, test and measurement routines, etc. In the illustrated example, the controller 308 may be configured to receive data from various sensors in the example apparatus 300 and execute different instructions depending on the data received. To store machine accessible instructions that, when executed by the controller 308, cause the controller 308 to implement control routines or any other processes, the electronics system 302 is provided with an electronic programmable read only memory (EPROM) 310.

To store, analyze, process and/or compress test and measurement data, or any kind of data, acquired by the example apparatus 300, the electronics system 302 is provided with a flash memory 312. To implement timed events and/or to generate timestamp information, the electronics system 302 is provided with a clock 314. To communicate information when the example apparatus 300 is downhole, the electronics system 302 is provided with a modem 316 that is communicatively coupled to the tool bus 306 and the subassembly 140 (FIG. 1). In this manner, the example apparatus 300 may send data to and/or receive data from the surface via the subassembly 140 and the modem 316.

In the illustrated example, the example apparatus 300 is configured to dissipate heat from a heat-generating source 322. In the illustrated example, the heat-generating source 322 is located within a collar, which may be used to implement the drill string 112 of FIG. 1 and/or the wireline tool 200 of FIG. 2. The heat-generating source 322 may be any one or more components, devices, or systems that generate heat (e.g., as a result of performing some other primary function or operation). For example, the heat-generating source 322 may be the alternator and its associated components 162 discussed above in connection with FIG. 1, or the heat-generating source 322 may be the downhole electrical control system 208 discussed above in connection with FIG. 2. In some example implementations, the heat-generating source 322 may be the electronics system 302. In any case, the heat-generating source 322 generates heat and, in the illustrated example, the example apparatus 300 is configured to dissipate that heat from the heat-generating source 322.

To draw heat from the heat-generating source 322, the example apparatus 300 is provided with a chassis 326. The chassis 326 has a surface 328 to thermally engage the heat-generating source 322 to enable thermal transfer from the heat-generating source 322 to the example chassis 326. To dissipate heat away from the chassis 326 and the heat-generating source 322, the chassis 326 is provided with a fluid passageway 330 formed therethrough to allow a fluid to flow through the chassis 326 to draw heat from the chassis 326 and deliver the heat-ladened fluid away from the chassis 326 and the heat-generating source 322. In the illustrated example, fluid flows through an inflow passageway 332, into the chassis 326 through a chassis fluid inlet 334 and exits the chassis 326 through a chassis fluid outlet 336. To dissipate heat away from the heat-generating source 322, fluid that enters the inlet 334 has a relatively lower temperature than the chassis 326, which draws the heat from the heat-generating source 322. Thus, the heat in the chassis 326 will transfer to the relatively cooler fluid flowing through the passageway 330. In this manner, as the fluid flows through the passageway 330, the fluid draws heat from the chassis 326 allowing the chassis 326 to dissipate more heat away from the heat-generating source 322. The fluid then flows out of the chassis 326 and into an outflow passageway 340 to dissipate its heat to other areas. For example, the heat in the fluid may be dissipated into the wellbore W surrounding the example apparatus 300.

To further dissipate heat from the heat-generating source 322, the example apparatus 300 is provided with a radiator 344. The radiator 344 has a surface 346 to thermally engage the chassis 326 to enable thermal transfer from the chassis 326 to the radiator 344. In the illustrated example, the radiator 344 is exposed to the wellbore W so that the radiator 344 can dissipate heat from the chassis 326 into the wellbore W. For example, the radiator 344 can dissipate the heat into air, drilling fluid, and/or formation fluid in the wellbore W. In some example implementations, the radiator 344 can be a housing or sleeve of a tool collar, thus increasing the amount of material of the radiator 344 that can draw heat from the chassis 326 and also increasing the surface area of the radiator 344 to dissipate heat to the wellbore W. In some example implementations, the radiator 344 can additionally or alternative be located in or exposed to an inner cavity of a tool collar to dissipate heat to air or drilling fluid flowing through the inner cavity. The illustrated examples of FIGS. 4A, 4B, 5, 6A-6C, 7A, 7B, and 8 may be used to implement the example apparatus 300 of FIG. 3.

To move fluid through the passageways 330, 332, and 340 and the chassis 326, the example apparatus 300 is provided with a pump 348. The pump 348 may be driven by an electrical motor or any other suitable device. In the illustrated example, the operation of the pump 348 is controlled by the controller 308. For example, the controller 308 may be configured to start and stop the pump 348 and/or change the pump rate of the pump 348.

To sense the temperature of the chassis 326, the example apparatus 300 is provided with a temperature sensor 352. To sense the temperature of the wellbore W, the example apparatus 300 is provided with another temperature sensor 354. In the illustrated example, the sensors 352 and 354 are coupled to the controller 308. In this manner, the controller 308 can acquire temperature information from the sensors 352 and 354 and use the temperature information to control the pump 348. For example, the controller 308 may be configured to start the pump 348 when the temperature of the chassis 326 meets or exceeds a predetermined temperature threshold and stop the pump 348 when the chassis 326 falls below the same threshold or another threshold. In addition, the controller 308 may be configured to increase the pump rate as the temperature of the chassis 326 increases and decrease the pump rate as the temperature of the chassis 326 decreases. In some example implementations, the temperature of the chassis 326 may be indicative of the temperature of the heat-generating source 322.

The controller 308 may also be configured to start the pump 348 when the temperature of the wellbore W (measured using the sensor 354) exceeds the temperature of the chassis 326 or some other temperature value, which may be based on the chassis temperature. In addition, the controller 308 may be configured to stop the pump 348 based on the temperature of the wellbore W. In this manner, when the temperature of the chassis 326 is lower than the temperature of the wellbore W, the chassis 326 can use the radiator 344 to dissipate heat into the wellbore W. However, when the temperature of the chassis 326 is equal to or greater than the temperature of the wellbore W, heat will not dissipate from the chassis 326 to the wellbore W. Instead, the controller 308 can start and/or increase the pump rate of the pump 348 to increase the flow rate of fluid through the chassis 326 to draw heat away from the chassis 326 via the fluid.

To maintain the pressure of the fluid in the passageways 330, 332, and 340 substantially equal to the atmospheric pressure inside of a tool collar, drill string, or wireline tool in which the example apparatus 300 is implemented, the example apparatus 300 is provided with a compensator 358. In the illustrated example, the compensator 358 includes a spring and piston assembly that work cooperatively to regulate the fluid pressure in the passageways 330, 332, and 340. Keeping the pressure of the fluid substantially equal to the surrounding atmospheric pressure enables reducing the structural strength requirements of the chassis 326 and the passageways 330, 332, and 340, which in turn leads to less space required by the apparatus 300 and more space available in the drill string or wireline tool collar for other uses. Although the compensator 358 in the illustrated example of FIG. 3 is implemented using a spring and piston assembly, the compensator 358 may alternatively be implemented using any other suitable pressure compensation system including, for example, one or more bladders, one or more bellows, etc.

Figure 4A:
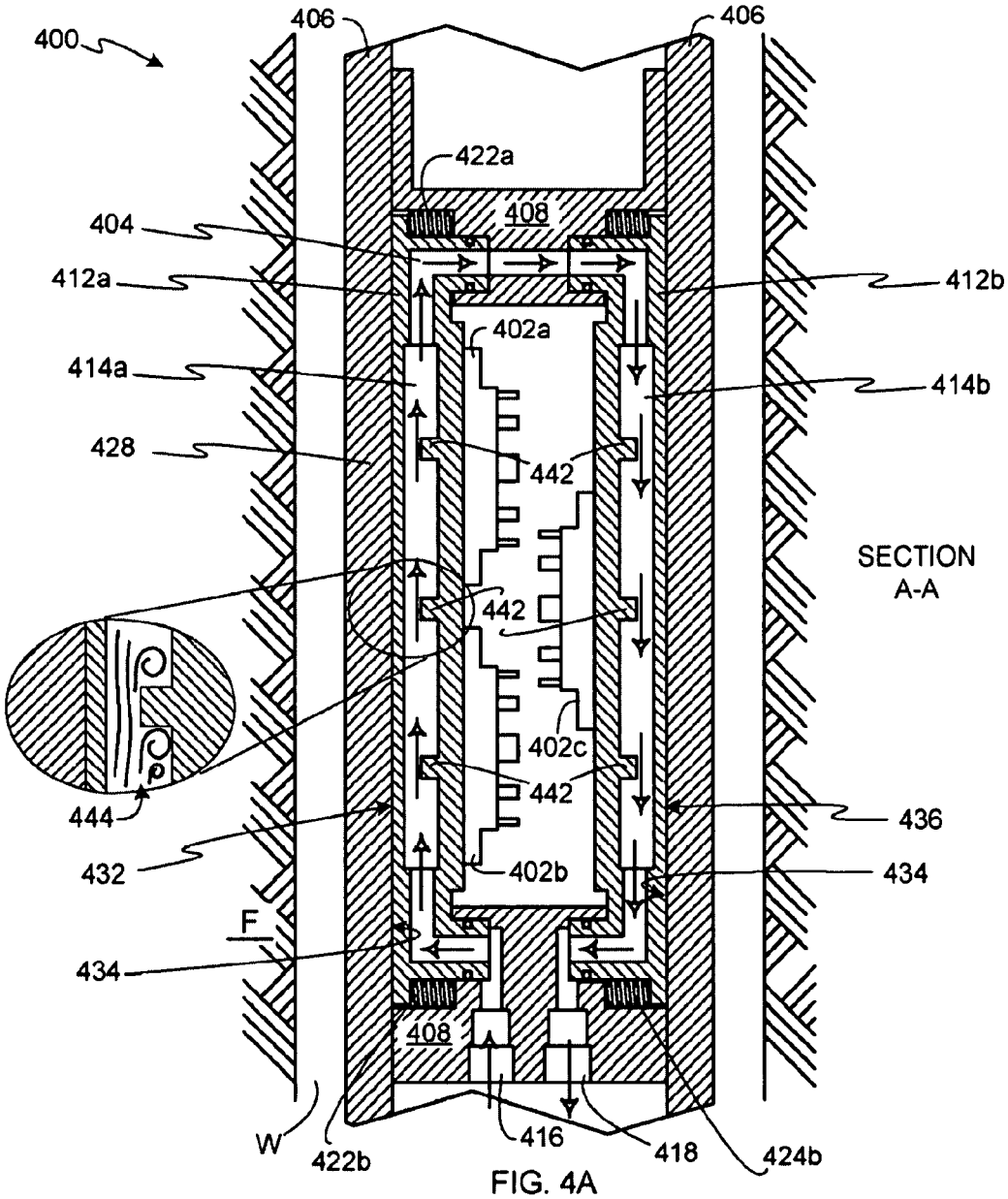
FIG. 4A depicts a cross-sectional side view and FIG. 4B depicts a cross-sectional end view of an example apparatus that may be used to dissipate heat from heat-generating devices by moving a fluid towards and away from the heat-generating devices.
Figure 4B:
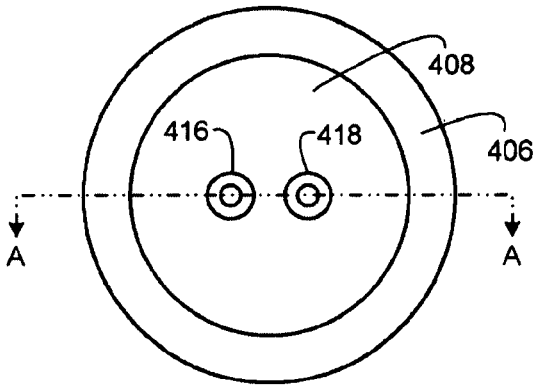

FIG. 4A depicts a side cross-sectional view and FIG. 4B depicts an end cross-sectional view of an example apparatus 400 that may be used to dissipate heat from heat-generating devices 402*a-c* (e.g., the heat-generating source 322 of FIG. 3) by moving a fluid towards and away from the heat-generating devices 402*a-c* via a fluid passageway 404. In the illustrated example, the example apparatus 400 is installed in a collar 406 that may be used in connection with the drill string 112 (FIG. 1) or the wireline tool 200 (FIG. 2).

In the illustrated example, the example apparatus 400 is provided with a body or a base 408 having chassis pads 412*a-b* mounted thereon. The heat-generating devices 402*a-b* are mounted on the chassis pad 412*a*, and the heat-generating device 402*c* is mounted on the chassis pad 412*b*. The functions of the chassis pads 412*a-b* are substantially similar or identical to the functions described above in connection with the chassis 326 of FIG. 3. The chassis pad 412*a* includes a fluid passageway 414*a*, and the chassis pad 412*b* includes another fluid passageway 414*b* to enable a fluid to be moved through the chassis pads 412*a-b*. As shown, the fluid passageways 414*a-b* form a portion of the fluid passageway 404 to enable fluid to be moved through the example apparatus 400 to dissipate heat away from the heat-generating devices 402*a-c*. To increase heat transfer performance, in the illustrated example, the chassis pads 412*a-b* are made using a material with a relatively high thermal conductivity. In addition, the fluid may be a hydraulic fluid or any other fluid suitable for transferring heat away from the heat-generating devices 402*a-b*.

The fluid is moved through the passageway 404 using a pump such as, for example, the pump 348 of FIG. 3. To move fluid through the passageway 404, the body 408 of the example apparatus 400 is provided with a fluid inlet 416 and a fluid outlet 418. The fluid inlet 416 may be coupled to a passageway (not shown) coupled to an output port of a pump (e.g., the pump 348 of FIG. 3), and the fluid outlet 418 may be coupled to another passageway (not shown) coupled to an input port of the pump. In the illustrated example, the pump forces relatively cooler fluid into the fluid inlet 416, the fluid moves through the passageway 404 drawing heat from the chassis pads 412*a-b* (which draw heat from the heat-generating devices 402*a-c*), thus, elevating the temperature of the fluid, and the fluid then exits the body 408 through the fluid outlet 418 to dissipate the heat. The fluid is then drawn by the pump and forced back through the passageway 404 to continue dissipating heat away from the heat-generating devices 402*a-c*. In some example implementations, the fluid flow rate provided by the pump can be controlled to adjust the heat transfer performance of the example apparatus 400.

In the illustrated example, the chassis pads 412*a-b* are also configured to transfer heat outwardly toward the wellbore W and the formation F. In the illustrated example, the chassis pads 412*a-b* are mounted on the body 408 via respective compression springs 422*a-b* and 424*a-b* to push the chassis pads 412*a-b* against a housing 428 (e.g., a sleeve) of the collar 406. In particular, the springs 422*a-b* are disposed between the body 408 and the chassis pad 412*a* to apply an outward force against the chassis pad 412*a* causing an outer surface 432 of the chassis pad 412*a* to thermally engage or thermally couple to an inner surface 434 of the housing 428. In similar manner, the springs 424*a-b* are disposed between the body 408 and the chassis pad 412*b* to apply an outward force against the chassis pad 412*b* causing an outer surface 436 of the chassis pad 412*b* to thermally engage or thermally couple to the inner surface 434 of the housing 428. In this manner, the housing 428 can be used as a radiator (e.g., the radiator 344 described above in connection with FIG. 3) to dissipate heat from the chassis pads 412*a-b* to the wellbore W and the formation F.

In the illustrated example, the passageways 414*a-b* are provided with respective protrusions 442 (e.g., obstacles) to improve the performance of heat transfer from the chassis pads 412*a-b* to the fluid flowing through the passageways 414*a-b* and the overall heat transfer efficiency of the example apparatus 400 as the fluid flows through the passageway 404 to deliver heat away from the heat-generating devices 402*a-c*. In the illustrated example, the protrusions 442 are implemented using baffles. To improve heat transfer performance and efficiency, the baffles 442 interfere with fluid flow to increase the amount of mixing that occurs in the fluid as the fluid flows through the passageways 414*a-b*. For example, when the baffles 442 obstruct the flow of fluid, the fluid mixes as shown by reference numeral 444 causing higher temperature fluid to mix with lower temperature fluid and, thus, lowering the overall temperature of the fluid to enable more heat to be transferred from the chassis pads 412*a-b* to the fluid. As described below in connection with FIG. 6C, the dimensions of the baffles 442 can be selected to change the fluid mixing effect. For example, the dimensions of the baffles 442 may, in some example implementations, be selected to maximize the mixing effect.

Figure 5:
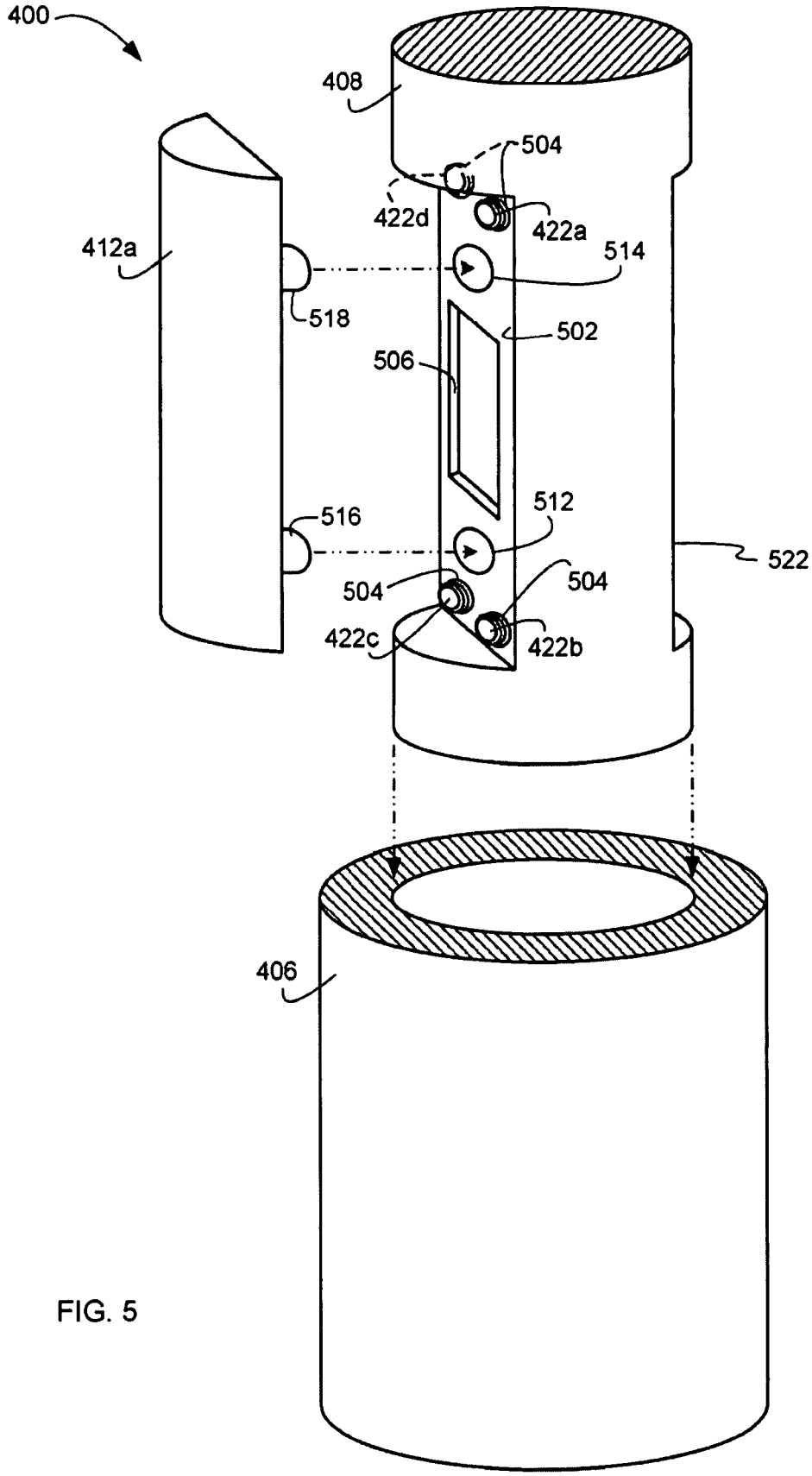
FIG. 5 is an isometric view of the example apparatus of FIGS. 4A and 4B.

FIG. 5 is an isometric view of the example apparatus 400 of FIGS. 4A and 4B. As shown in FIG. 5, the body 408 includes a recessed surface 502 having apertures 504 to receive the compression springs 422*a-d*. An aperture 506 is formed in the recessed surface 502 to receive the heat-generating devices 402*a-b* (FIG. 4A). In addition, an outlet port 512 and an inlet port 514 are formed in the recessed surface 502 to enable fluid to flow into and out of the chassis pad 412*a*. In the illustrated example, the chassis pad 412*a* includes a chassis pad inlet port 516 and a chassis pad outlet port 518, which are fluidly coupled to the passageway 414*a* of the chassis pad 412*a* shown in FIG. 4A. When the chassis pad 412*a* is coupled to the body 408 at the recessed surface 502, the outlet port 512 of the body 408 receives the inlet port 516 of the chassis pad 412*a* and the inlet port 514 of the body 408 receives the outlet port 518 of the chassis pad 412*a*. In addition, when the chassis pad 412*a* is coupled to the body 408, the chassis pad 412*a* engages the compression springs 422*a-d*. When the assembled body 408 and the chassis pad 412*a* are placed or slid in the housing 406, the compression springs 422*a-d* exert an outward force against the chassis pad 412*a* so that the chassis pad 412*a* thermally engages the housing 406 as discussed above in connection with FIG. 4A to dissipate heat to the wellbore W and the formation F via the housing 406 as the housing functions as a radiator (e.g., the radiator 344 of FIG. 3).

Although not shown in detail, the body has another recessed surface 522 having features similar to those described in connection with the recessed surface 502. In the illustrated example, the body 408 is configured to receive the chassis pad 412*b* (FIG. 4A) via the recessed surface 522.

Figure 6A:
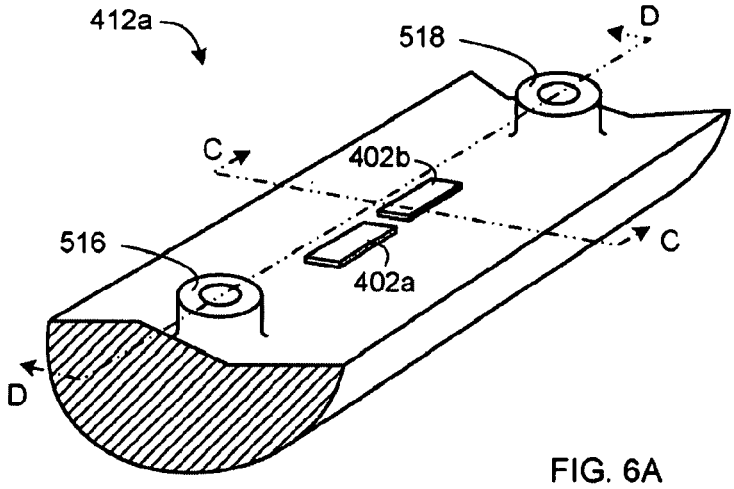
FIG. 6A is an isometric view of a chassis pad of the example apparatus of FIGS. 4A, 4B, and 5.

FIG. 6A is an isometric view of the chassis pad 412*a* of the example apparatus of FIGS. 4A, 4B, and 5. FIG. 6A depicts the inlet port 516 and the outlet port 518 of the chassis pad 412*a*. In addition, the heat-generating devices 402*a-b* are shown mounted to (or engaging) the chassis pad 412*a*. In some example implementations, the heat-generating devices 402*a-b* may be fixedly coupled or removably coupled to the chassis pads 412*a*. In other example implementations, the heat generating devices 402*a-b* may be mounted in the body 408 (FIGS. 4A and 5) and when the chassis pad 412*a* is assembled with or mounted to the body 408, the heat-generating devices 402*a-b* thermally engage the chassis pad 412*a* to transfer heat from the heat-generating devices 402*a-b* to the chassis pad 412*a*.

Figure 6B:
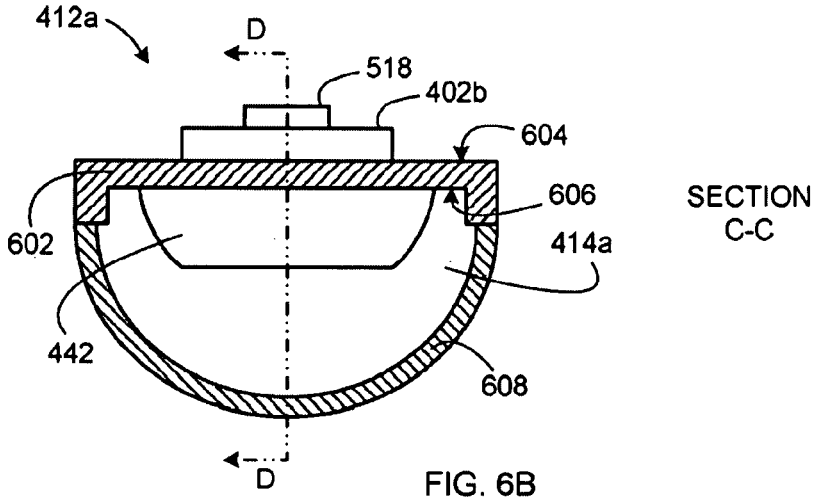
FIG. 6B is a cross-sectional end view of the chassis pad of FIGS. 4A, 4B, 5, and 6A.

FIG. 6B is a C-C cross-sectional end view of the chassis pad 412*a* of FIGS. 4A, 4B, 5, and 6A. In the illustrated example, the passageway 414*a* is implemented by forming a chamber in the chassis pad 412*a* that occupies a significant part of the volume of the chassis pad 412*a*. One of the protrusions 442 (FIG. 4A) is shown extending into the passageway 414*a*. A first chassis pad wall 602 has an outer surface 604 that is configured to receive the heat-generating devices 402*a-b* and that has the inlet port 516 and the outlet port 518 formed thereon. An inner surface 606 of the first chassis pad wall 602 is exposed to the passageway 414*a* and has the protrusions 442 formed thereon. As the heat-generating devices 402*a-b* generate heat, the heat is dissipated into the first chassis pad wall 602 and transfers from the outer surface 604 to the inner surface 606 and the protrusions 442. As fluid flows through the passageway 414*a*, the fluid contacts the inner surface 606 and the protrusions 442 to draw the heat from the first chassis pad wall 602. In this manner, when the fluid flows through the passageway 414*a*, the heat is transferred from the heat-generating devices 402*a-b* to the fluid.

The chassis pad 412*a* is provided with a second chassis pad wall 608, which may be coupled (e.g., welded, bolted, etc.) or integrally formed with the first chassis pad wall 602 to form the passageway 414*a*. In the illustrated example, the chassis pad wall 608 is implemented using a curved wall to maximize the amount of surface area that thermally engages the housing 406 (FIGS. 4A and 5). However, in other example implementations, the chassis pad wall 608 may be implemented using any other shaped wall suitable for the particular application. As fluid flows through the passageway 414*a*, some of the heat received from the heat-generating devices 402*a-b* is carried away by the fluid while some of the heat is transferred to the second chassis pad wall 608. In this manner, the chassis pad wall 608 can dissipate some of the heat to the wellbore W and the formation F (FIG. 4A) via the housing 406 (FIGS. 4A, 4B, and 5), which can function as a radiator (e.g., the radiator 344 of FIG. 3).

Figure 6C:
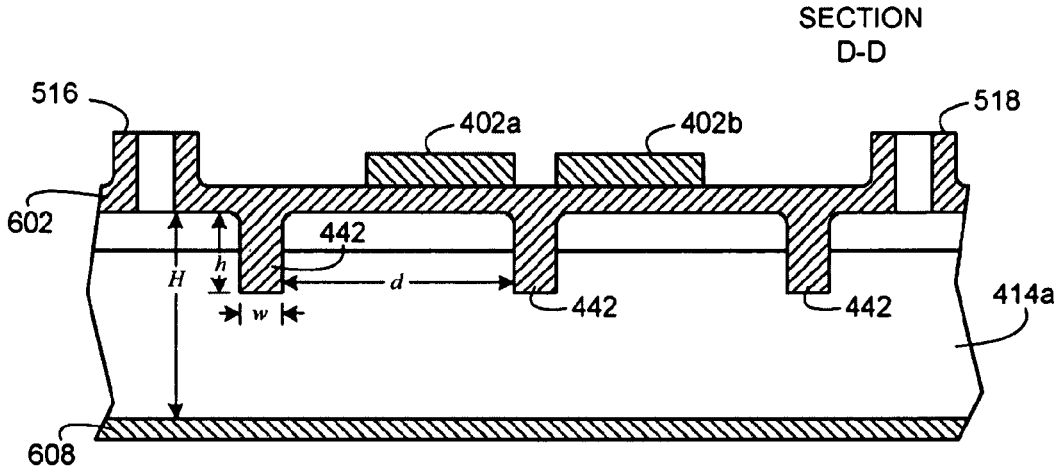
FIG. 6C is a cross-sectional side view of the chassis pad of FIGS. 4A, 4B, 5, 6A and 6B.

FIG. 6C is a cross-sectional side view of the chassis pad of FIGS. 4A, 4B, 5, 6A and 6B. The protrusion height (h) and width (w) of the protrusions or baffles 442 are shown relative to the passageway height (H) and overall size of the passageway 414*a*. In addition, the baffles 442 are shown separated by a baffle-to-baffle distance (d). In the illustrated example, the protrusion height (h) of the baffles 442 are shown as being less than the overall passageway height (H). The dimensions (h) and (w) of the baffles 442 and the spacing (d) between the baffles 442 can be selected to achieve a desired heat transfer efficiency or performance by modifying the amount of surface area available to transfer heat from the chassis pad 412*a* to the fluid and by modifying the amount of fluid flow interference created by the baffles 442. For example, the protrusion height (h) and/or width (w) may be increased to increase the surface area exposed to fluid flowing through the passageway 414*a* so that more surface area of each baffle 442 is available to transfer heat from the heat-generating devices 402*a-b* to the fluid. However, increasing the protrusion height (h) and/or width (w) too much may hinder the flow of fluid through the passageway 414*a* and decrease the fluid mixing effect. In some example implementations, the height (h) of the baffles 442 relative to the height (H) of the passageway 414*a* is preferably as large as an acceptable pressure drop will allow. Increasing the height (h) of the baffles 442 in turn increases the amount of fluid mixing, which in turn improves the performance of heat transfer to the fluid. However, increasing the height (h) of the baffles 442 also increases fluid flow resistance, thus, decreasing fluid pressure. In some example implementations, the width (w) of a baffle 442 is preferably kept to a minimum and is determined by the manufacturability of the baffled 442 based on, for example, the material used and the height (h) of the baffle 442. Relatively wider baffles may cause unnecessary reductions in fluid pressure. Thus, in some example implementations, the baffles 442 may be made as thin as allowed by the structural integrity required for a particular application.

In some example implementations, the distance (d) between the baffles 442 is preferably selected to be more then six times but less than eight times the height (h) of the baffles 442, because turbulent flow in the fluid re-attaches (or diminishes) at a distance away from a baffle that equals about six times the height (h) of the baffle. Thus, the height (h) and width (w) of each baffle 442 may be selected to achieve a desired amount of surface area of the chassis pad wall 602 exposed to the fluid while also achieving a desired fluid flow through and fluid mixing effect in the passageway 414*a*. In addition, the length of the passageways 414*a-b* may be selected to change the performance of heat transfer to the fluid flowing through the passageway 414*a-b*.

In the illustrated example, the baffles 442 are shown as rectangular structures that are equally spaced apart. However, in other example implementations, the baffles 442 can be implemented using different shapes and each baffle can be implemented using a shape different from the other baffles. In addition, the baffles 442 can alternatively be spaced apart using different distances between each baffle. In some example implementations, baffles may be structured perpendicular to the flow of fluid. However, in other example implementations, baffles may be non-perpendicular to the flow of fluid.

Figure 7A:
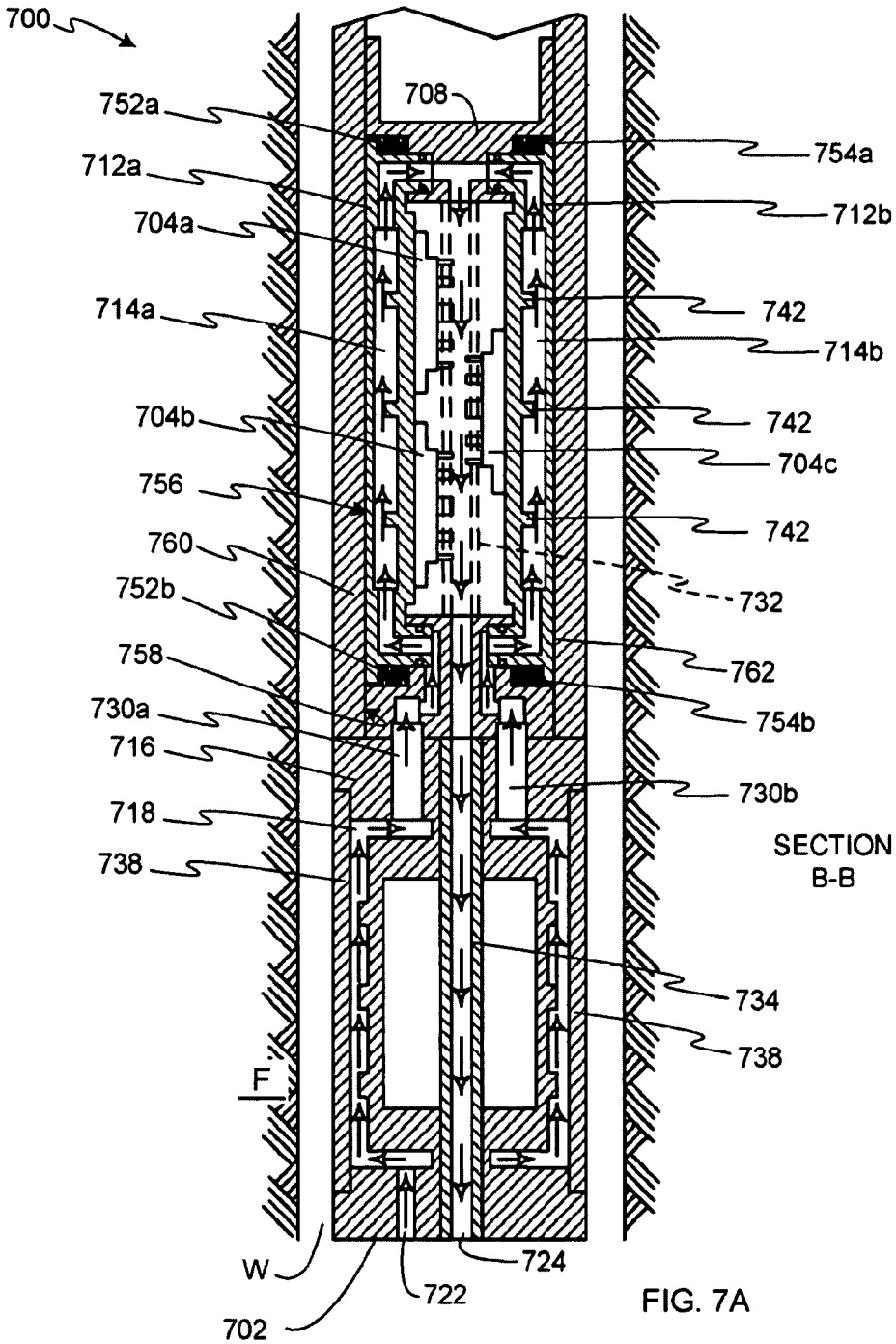
FIG. 7A depicts a cross-sectional side view and FIG. 7B depicts a cross-sectional end view of another example apparatus having an example heat exchanger extension to dissipate heat from heat-generating devices.
Figure 7B:
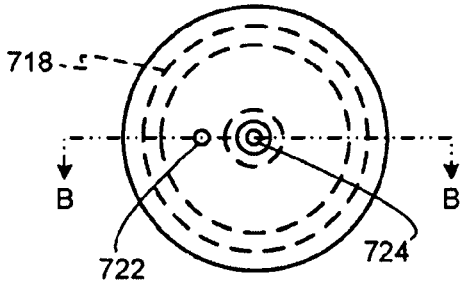

FIG. 7A depicts a cross-sectional side view and FIG. 7B depicts a cross-sectional view end of another example apparatus 700 having a heat exchanger extension 702 to dissipate heat from the heat-generating devices 704*a-c* by moving a fluid through a plurality of fluid passageways. In the illustrated example, the example apparatus 700 is provided with a body 708 and chassis pads 712*a-b* coupled to the body 708. The chassis pads 712*a-b* may be implemented to be substantially similar or identical to the chassis pads 412*a-b* of FIG. 4A. Each of the chassis pads 712*a-b* includes a respective fluid passageway 714*a* and 714*b* through which fluid is circulated through the example apparatus 700.

Figure 8:
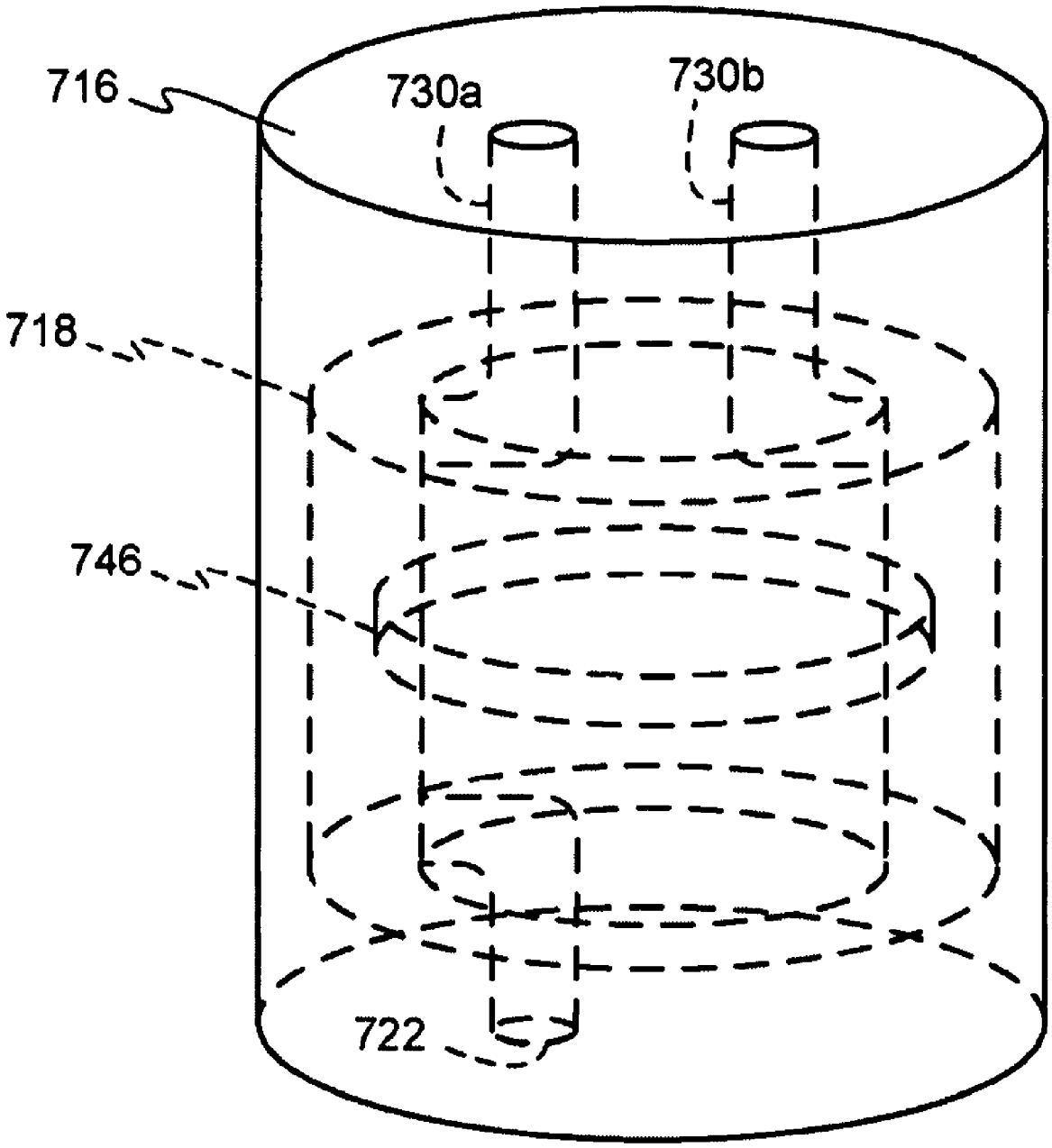
FIG. 8 is an isometric view of the example heat exchanger extension of FIGS. 7A and 7B.

The heat exchanger extension 702 is provided to improve the performance of heat transfer from the fluid to the wellbore W and the formation F by increasing the surface area of passageways in contact with the fluid to which heat can be transferred from the fluid and by increasing the overall flow path length over which the fluid can mix relatively more effectively. The length of the heat exchanger extension 702 and the passageways therein can be selected to increase the effective heat transfer. In the illustrated example, the heat exchanger extension 702 includes a body 716 provided with an annular inflow cavity 718 formed in the body 716. The annular inflow cavity 718 is fluidly coupled to the fluid passageway 714*a* of the chassis pad 712*a* and the fluid passageway 714*b* of the chassis pad 712*b*. An isometric view of the body 716 is depicted in FIG. 8 to show how the annular inflow cavity 718 is formed in the body 716.

Turning back to FIG. 7A, the body 716 also includes a fluid inlet port 722 and a fluid outlet port 724. As fluid enters the inlet port 722, the fluid flows through the heat exchanger extension 702 toward the chassis pads 712*a-b* via the annular inflow cavity 718 (FIGS. 7A, 7B, and 8) in a direction generally indicated by arrows 726 (FIG. 7A). The fluid then diverts to two passageways 730*a* and 730*b* (FIGS. 7A and 8) to enter the body 708 and flows through the passageways 714*a-b* of the chassis pads 712*a-b*, at which point the fluid draws heat from the heat-generating devices 704*a-c* as it flows through the chassis pads 712*a-b*.

To move fluid out of the body 708 and away from the heat generating devices 704*a-c*, the body 708 is provided with an outflow fluid passageway 732 fluidly coupled to the passageways 714*a-b*, and the body 716 of the heat exchanger extension 702 is provided with another outflow fluid passageway 734 fluidly coupled to the outflow fluid passageway 732. The fluid passageways 732 and 734 may be implemented using hollow tubes. As fluid exits the fluid passageways 714*a-b*, the fluid combines to flow through the outflow fluid passageways 732 and 734 and out of the heat exchanger extension 702 via the fluid outlet port 724. The fluid can then flow through other passageways (not shown) to cool the fluid by transferring the heat to the wellbore w and the formation F before pumping the fluid (via, for example, the pump 348 of FIG. 3) back into the fluid inlet 722. The fluid that flows through the annular inflow cavity 718 is relatively cooler than fluid that flows out through the outflow fluid passageway 734. However, the relatively cooler fluid in the annular cavity 718 may still have some heat that can be further dissipated radially toward the wellbore W and the formation F through one or more radiator pads 738 (or a housing of the body 716).

In the illustrated example, the outflow fluid passageways 732 and 734 are located coaxial to the bodies 708 and 716. However, in other example implementations, the outflow fluid passageways 732 and 734 may be routed differently through the bodies 708 and 116. In addition, although the fluid from the passageways 714*a-b* is described as combining in the outflow fluid passageways 732 and 734, in other example implementations, respective outflow fluid passageways may be provided for each of the passageways 714*a-b* so that the fluid from the passageways 714*a-b* does not combine in the bodies 708 and 716 or combine at some other point in the bodies 708 and/or 716.

Referring to the chassis pads 712*a-b* coupled to the body 708, to improve the performance of heat transfer from the chassis pads 712*a-b* to the fluid flowing through the passageways 714*a-b* and the overall heat transfer efficiency of the example apparatus 700, the passageways 714*a-b* are provided with respective protrusions 742, which are substantially similar or identical to the protrusions 442 of FIGS. 4A, 6B, and 6C. In addition, the heat exchanger extension 702 is provided with protrusions 746 that are substantially similar or identical to the protrusions 742 and 442. FIG. 8 depicts an isometric view of one of the protrusions 746, which is formed as an annular protrusion in the inflow annular cavity 718.

In the illustrated example of FIG. 7A, the chassis pads 712*a-b* are mounted on the body 708 via respective compression springs 752*a-b* and 754*a-b*. In particular, the springs 752*a-b* are disposed between the body 708 and the chassis pad 712*a* to apply an outward force against the chassis pad 712*a* causing an outer surface 756 of the chassis pad 712*a* to thermally engage an inner surface 758 of a housing 760. In similar manner, the springs 754*a-b* are disposed between the body 708 and the chassis pad 712*b* to apply an outward force against the chassis pad 712*b* causing an outer surface 762 of the chassis pad 712*b* to thermally engage the inner surface 758 of the housing 760. In this manner, the housing 760 can be used as a radiator (e.g., the radiator 344 described above in connection with FIG. 3) to dissipate heat from the chassis pads 712*a-b* to the wellbore W and the formation F.

Although the example apparatus 400 and 700 are described above as having respective chassis pads 412*a-b* and 712 *a-b*, in other example implementations, the features and structures (e.g., passageways, protrusions (baffles), etc.) of the chassis pads 412*a-b* and 712*a-b* may be integrally formed with their respective bodies 408 and 708. In this manner, an example apparatus to perform the functions and operations described above can be implemented without separate chassis pads.

Figure 9:
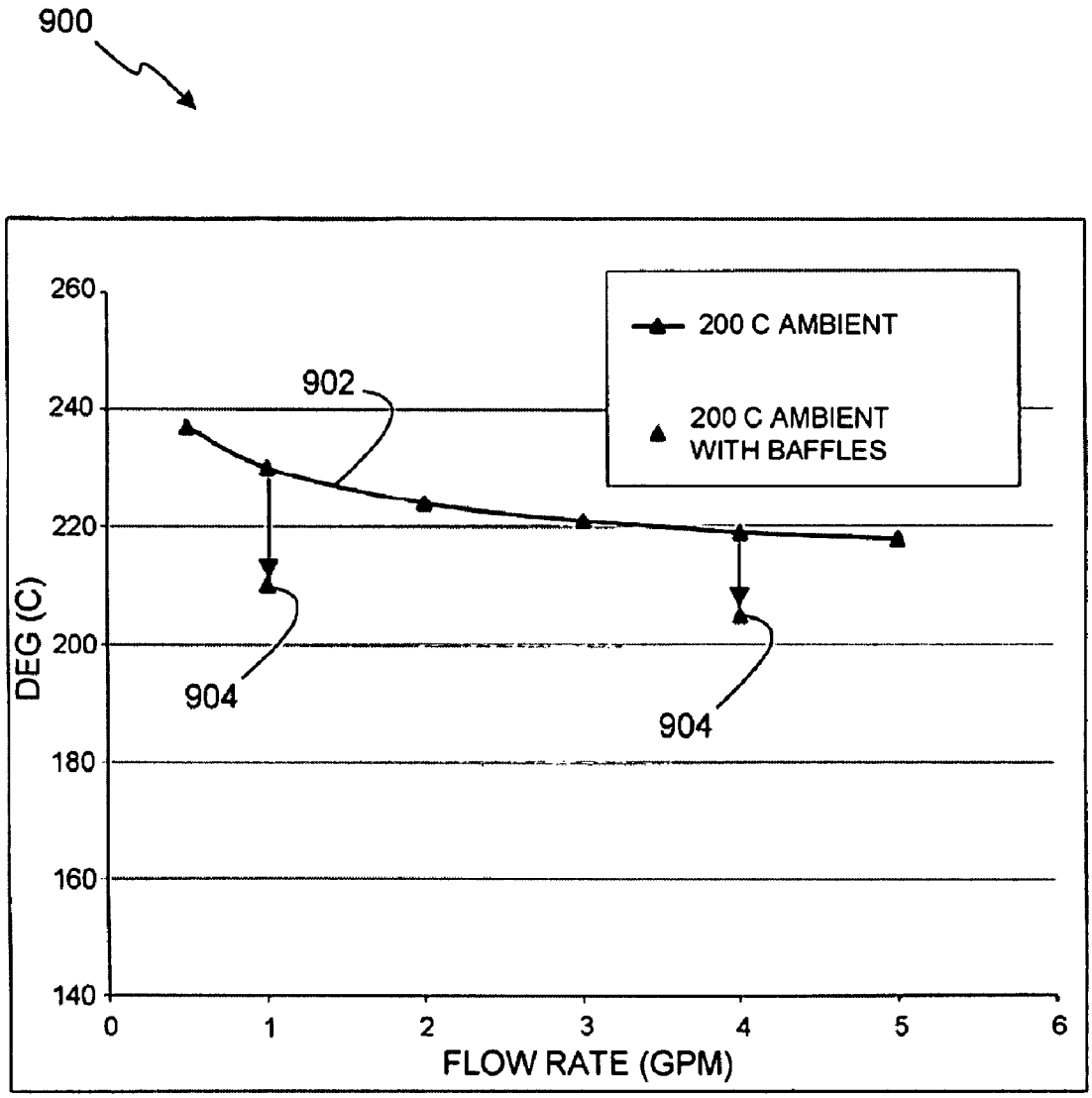
FIG. 9 is a chart showing the relationship between a temperature of a heat-generating device and a fluid flow rate through the example apparatus of FIG. 4.

FIG. 9 is a chart 900 showing the relationship between a temperature of a heat-generating device (e.g., one of the heat-generating devices 402*a-c* of FIG. 4) and a fluid flow rate through the example apparatus 400 of FIG. 4. The chart 900 has a temperature plot 902 of an apparatus similar to the example apparatus 400, but without the baffles 442 and a temperature plot 904 of the example apparatus 400 with the baffles 442. Both of the temperature plots 902 and 904 show that the temperatures of the heat-generating devices 402*a-c* decrease as the fluid flow rate increases through respective apparatus. However, the temperature plot 904 shows that providing the baffles 442 to the example apparatus 400 lowers the overall temperature of the example apparatus 400 by an offset of about 15°~20° C.

Figure 10:
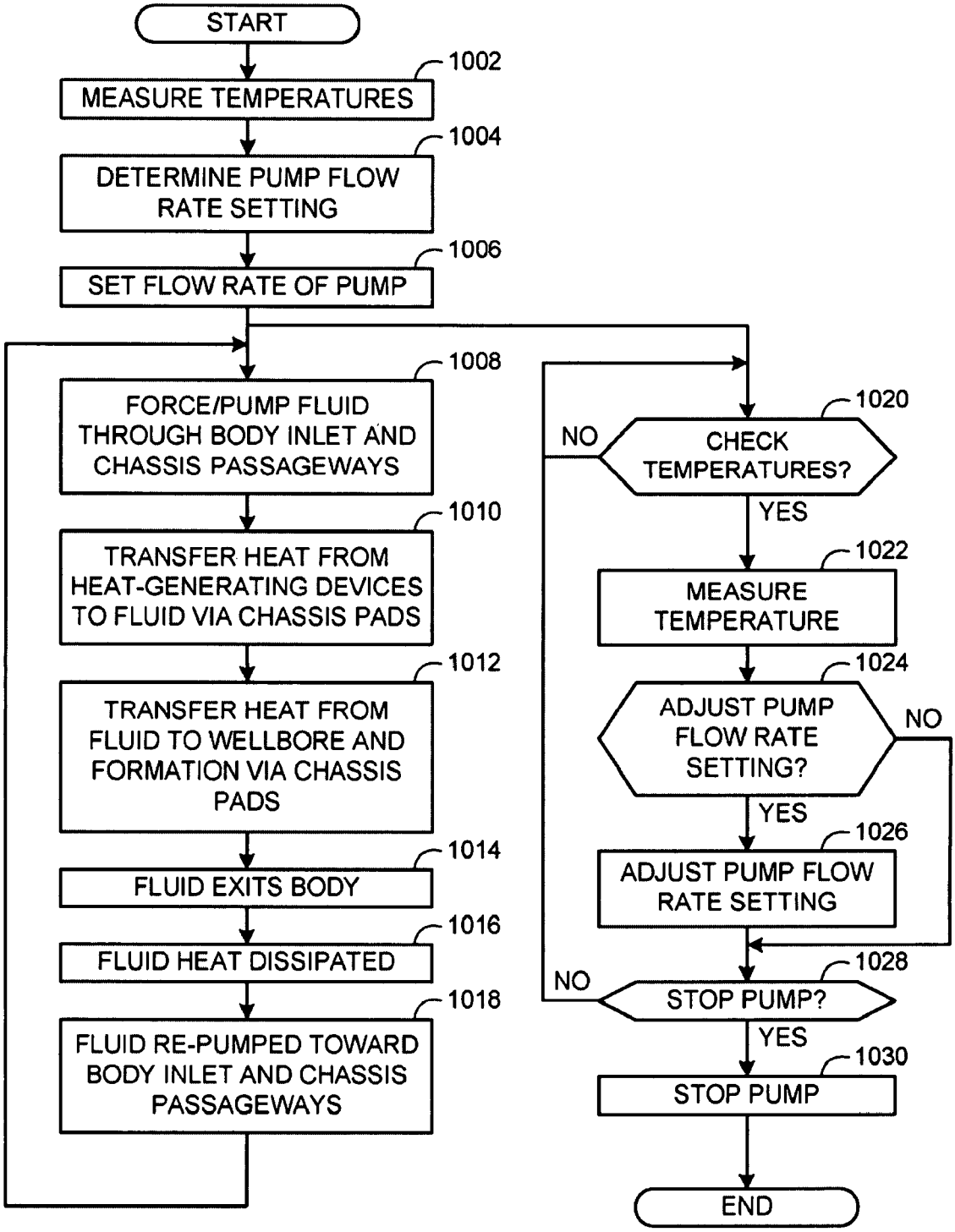
FIG. 10 is a flow diagram representative of an example method that may be used to dissipate heat using the example apparatus of FIGS. 4 and 7.

FIG. 10 is a flow diagram representative of an example method that may be used to dissipate heat using the example apparatus 400 of FIG. 4 and/or the example apparatus 700 of FIG. 7. In some example implementations, the example method of FIG. 10 may be implemented using machine readable instructions comprising a program for execution by a processor or controller (e.g., the controller 308 of FIG. 3). The program may be embodied in software stored on a tangible medium such as a CD-ROM, a floppy disk, a hard drive, a digital versatile disk (DVD), or a memory (e.g., the EPROM 302 of FIG. 3) associated with the controller 308 and/or embodied in firmware and/or dedicated hardware in a well-known manner. Further, although the example program is described with reference to the flow diagram illustrated in FIG. 10, persons of ordinary skill in the art will readily appreciate that many other methods of implementing the example apparatus 400 may alternatively be used. For example, the order of execution of the blocks may be changed, and/or some of the blocks described may be changed, eliminated, or combined. The example method of FIG. 10 is described in connection with the example apparatus 400 of FIG. 4 and the electronics system 302, the pump 348, and the temperature sensors 352 and 354 of FIG. 3. However, the example method of FIG. 10 may also be implemented in connection with the example apparatus 700 of FIG. 7.

Turning in detail to FIG. 10, initially, the controller 308 measures a temperature of the chassis pads 412*a-b* (FIG. 4) and a temperature of the wellbore W (block 1002) using, for example, the temperature sensors 352 and 354. The controller 308 then determines a flow rate setting for the pump 348 based on the measured temperatures (block 1004). For example, the controller 308 may execute instructions in the EPROM 302 that cause the controller 308 to select a relatively low flow rate setting if the chassis pads 412*a-b* have a relatively low temperature or a relatively high flow rate setting if the chassis pads 412*a-b* have a relatively high temperature.

The controller 308 then sets the pump 348 (FIG. 3) to pump fluid at the flow rate determined at block 1004 (block 1006). As the pump 348 operates, fluid is pumped into the example apparatus 400 through the fluid inlet 416 (FIGS. 4A and 4B) of the body 408 (FIG. 4A) and through the chassis passageways 414*a-b* (block 1008). In the illustrated example of FIGS. 4A, 5, and 6A-6C, the fluid flows through the fluid inlet 416 of the body 408, enters the chassis passageway 414*a* via the chassis pad inlet port 516 (FIGS. 4A, 5, and 6A-6C), exits the chassis passageway 414*a* via the chassis pad outlet port 518 (FIGS. 4A, 5, and 6A-6C), and enters the chassis passageway 414*b* of the chassis pad 412*b* (FIG. 4A).

As the fluid flows through the chassis passageways 414*a-b*, heat is transferred from the heat-generating devices 402*a-c* to the fluid (block 1010). For example, when the fluid flows through the chassis passageway 414*a*, the chassis pad wall 602 (FIGS. 6B and 6C) and the baffles 442 (FIGS. 4A, 6B, and 6C) transfer heat from the heat generating devices 402*a-b* to the fluid. In addition, the baffles 442 cause the fluid to mix as it flows through the passageways 414*a-b*. As the fluid flows through the passageways 414*a-b*, some of the heat transferred to the fluid is transferred from the fluid to the wellbore W and the formation F via the chassis pads 412*a-b* (block 1012). For example, as the fluid flows through the chassis pad 412*a*, some heat is transferred from the fluid to the chassis pad wall 608, which is thermally engaged to the housing 406. In this manner, the housing 406 functions like a radiator (e.g., the radiator 344 of FIG. 3) to transfer the heat radially outward to the wellbore W and the formation F.

The fluid then exits the body 408 (block 1014) via the fluid outlet 418 and moves toward a fluid heat dissipation stage. The heat is then dissipated from the fluid (block 1016) in the fluid heat dissipation stage. In some example implementations, the fluid heat dissipation stage may be implemented using a passive heat exchange apparatus (e.g., the heat exchanger extension 702 of FIG. 7) so that the heat is dissipated into the wellbore W and the formation F via, for example, outward radial heat transfer. In other example implementations, the fluid heat dissipation stage may be implemented using a simpler heat dissipation configuration or a more complex heat dissipation configuration. In any case, after the heat is dissipated from the fluid, the pump 348 (FIG. 3) re-pumps the fluid toward the body inlet 416 (FIGS. 4A and 4B) and the chassis passageways 414*a-b* (block 1018) to re-circulate the fluid through the body 408 to transfer more heat from the heat-generating devices 402*a-c* to the fluid. The operations of blocks 1008, 1010, 1012, 1014, 106, and 1018 are then repeated.

During the operations of blocks 1008, 1010, 1012, 1014, 1016, and 1018 described above, the controller 308 (FIG. 3) monitors the temperature of the wellbore W using the temperature sensor 354 and one or both of the chassis pads 412*a-b* using one or more sensors substantially similar or identical to the temperature sensor 352 (FIG. 3) to control the flow rate of the pump 348. In particular, the controller 308 performs the operations of blocks 1020, 1022, 1024, 1026, 1028, and 1030 as described below. Initially, the controller 308 determines whether it should check the temperatures (block 1020) of the wellbore W and the chassis pads 412*a-b*. For example, the controller 308 may be configured to measure temperatures at predefined intervals. If the controller 308 determines that it should not yet check temperatures, control remains at block 1020 until it is time to check the temperatures.

When the controller 308 determines that it should check the temperatures, the controller 308 measures the temperatures (block 1022) and determines based on the measured temperatures whether it should adjust the flow rate of the pump 348 (block 1024). For example, the controller 308 may be configured to decrease the flow rate setting of the pump 348 when the temperatures of the chassis pads 412*a-b* are below a threshold temperature value and to increase the flow rate setting when the temperatures are above the same or another threshold temperature value. Additionally or alternatively, the controller 308 may be configured to increase the flow rate of the pump 348 when the temperature of the wellbore W is above a threshold temperature value and to decrease the flow rate when the wellbore W temperature is below the same or a different threshold temperature value. The algorithm used to set the flow rates of the pump may be implemented as desired to suit particular implementations and different configurations of chassis pads and apparatus to dissipate heat, which may be similar to or different from the example apparatus 400 of FIG. 4 or the example apparatus 700 of FIG. 7.

If the controller 308 determines at block 1024 that it should adjust the flow rate of the pump 348, the controller 308 adjusts the pump flow rate setting (block 1026). After the controller 308 adjusts the pump flow rate setting (block 1026) or if the controller 308 determines that it should not adjust the pump flow rate setting (block 1024), the controller 308 determines whether it should stop the pump 348 (block 1028). If the controller 308 determines that it should not stop the pump 348, control is passed back to block 1020. Otherwise, if the controller 308 determines that it should stop the pump 348, the controller 308 stops the pump 348 (block 1030). For example, the controller 308 may determine that it should stop the pump 348 if the controller 308 receives a stop command (from a timer or other signal or from an operator). After the controller 308 stops the pump 348, the process of FIG. 10 ends.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus, comprising:

a downhole tool configured for conveyance within a wellbore extending into a subterranean formation, wherein the downhole tool comprises:

an electronics system comprising:

a controller configured to execute instructions based on received data;

a memory configured to store machine accessible instructions executed by the controller; and means for communicating information with a surface-located communications subassembly;

wherein at least one of the controller, the memory, and the information communicating means is a heat-generating source;

a heat-dissipating apparatus comprising:

a chassis having a surface configured to thermally engage the heat-generating source and comprising a fluid passageway formed therethrough to allow a fluid to flow through the chassis to draw heat from the chassis and the heat-generating source;

a radiator comprising a surface configured to thermally engage the chassis to enable thermal transfer from the chassis to the radiator, wherein the radiator is exposed to the wellbore so that the radiator can dissipate heat from the chassis into the wellbore, and wherein the radiator forms at least a portion of a housing of the downhole tool;

a pump configured to move fluid through the passageway of the chassis, wherein operation of the pump is controlled by the controller;

a first temperature sensor electrically coupled to the controller and configured to sense the temperature of the chassis, wherein the data received by the controller includes the sensed temperature of the chassis;

a second temperature sensor electrically coupled to the controller and configured to sense the temperature of the wellbore, wherein the data received by the controller includes the sensed temperature of the wellbore; and a compensator comprising a spring and piston assembly configured to cooperatively regulate the pressure of the fluid in the passageway to be substantially equal to the atmospheric pressure inside of the housing;

wherein the controller is configured to:

acquire temperature information from the first and second temperature sensors and control the pump based on the temperature information;

start the pump when the temperature of the chassis meets or exceeds a predetermined temperature threshold and stop the pump when the chassis falls below the same threshold or another threshold;

start the pump when the temperature of the wellbore exceeds the temperature of the chassis and stop the pump when the temperature of the wellbore is lower than the temperature of the chassis; and increase the pump rate as the temperature of the chassis increases and decrease the pump rate as the temperature of the chassis decreases.

2. The apparatus of claim 1 wherein the heat-dissipating apparatus further comprises a body having a chassis pad mounted thereon, wherein the chassis pad comprises at least a portion of the fluid passageway, and wherein the heat-generating source is mounted on the chassis pad.

3. The apparatus of claim 2 wherein the chassis pad is mounted on the body via a compression spring configured to push the chassis pad against the housing of the downhole tool, wherein the compression spring is disposed between the body and the chassis pad to apply an outward force against the chassis pad causing an outer surface of the chassis pad to thermally engage an inner surface of the housing.

4. The apparatus of claim 3 wherein the at least portion of the passageway comprised by the chassis pad comprises protrusions configured to induce mixing of fluid flowing therethrough.

5. The apparatus of claim 4 wherein the at least portion of the passageway comprised by the chassis pad comprises a chamber in the chassis pad that occupies a substantial part of the volume of the chassis pad.

6. The apparatus of claim 4 wherein:

the body comprises a recessed surface having apertures configured to receive the compression spring;

the body comprises an aperture formed in the recessed surface and configured to receive the heat-generating source;

an outlet port and an inlet port are formed in the recessed surface to enable fluid to flow into and out of the chassis pad;

the chassis pad includes a chassis pad inlet port and a chassis pad outlet port which are fluidly coupled to the passageway of the chassis pad such that the outlet port of the body receives the chassis pad inlet port and the inlet port of the body receives the chassis pad outlet port; and the chassis pad engages the compression spring.

7. The apparatus of claim 6 wherein the at least portion of the passageway comprised by the chassis pad comprises a first chassis pad wall comprising a curved portion and a second chassis pad wall comprising:

an outer surface configured to receive the heat-generating source and on which the chassis pad inlet and outlet ports are formed; and an inner surface exposed to the passageway and having baffles formed thereon and configured to induce mixing of adjacent fluid flow.

8. The apparatus of claim 7 wherein the baffles are each separated by a distance that is greater than six times a height of the baffles but less than eight times the height of the baffles.

9. The apparatus of claim 8 wherein the baffles are rectangular structures that are equally spaced apart.

10. The apparatus of claim 9 wherein the baffles are perpendicular to adjacent fluid flow.

11. The apparatus of claim 3 wherein the downhole tool comprises a heat exchanger extension comprising the heat-dissipating apparatus.

* * * * *